US006006463A

United States Patent [19]

Mueller

[11] Patent Number: 6,006,463

[45] Date of Patent: Dec. 28, 1999

[54] LABEL HOLDER

[75] Inventor: Paul A. Mueller, Wadsworth, Ohio

[73] Assignee: Fasteners For Retail, Inc., Cleveland, Ohio

[21] Appl. No.: 09/132,785

[22] Filed: Aug. 12, 1998

[51] Int. Cl.[6] ..... G09F 3/00

[52] U.S. Cl. ..... 40/642.01; 40/658; 211/57.1; 211/59.1

[58] Field of Search ..... 40/642.01, 651, 40/657, 658, 661.03, 642.02; 211/57.1, 59.1; 248/291.1, 286.1

[56] References Cited

U.S. PATENT DOCUMENTS

| | | | |
|---|---|---|---|
| 3,912,084 | 10/1975 | Valiulis | 248/220.22 |
| 4,345,470 | 8/1982 | Hof et al. | 374/106 |
| 4,394,909 | 7/1983 | Valiulis et al. | 211/59.1 |
| 4,525,944 | 7/1985 | Fast | 40/642.01 |
| 4,715,135 | 12/1987 | Fast | 40/642.01 |
| 5,088,606 | 2/1992 | Boas | 211/57.1 |
| 5,123,189 | 6/1992 | Fast et al. | 40/642.01 |
| 5,235,766 | 8/1993 | Fast et al. | 40/642.01 X |
| 5,325,616 | 7/1994 | Valiulis | 40/642.01 |
| 5,421,113 | 6/1995 | Gebka et al. | 40/642.01 |

OTHER PUBLICATIONS

Fast Industries Catalog vol. 2 entitled "The FAST Way to a Better Bottom Line" (cover page and pp. 2–12) (circa 1997).

Southern Imperial, Inc.—Display Hooks, Label Holders, & Merchandising Accessories Catalog (Mar. 19, 1996 Form: DHLHC–102495–B) 3 pgs.

AGT, Inc.—1 pg. advertisement (circa 1997).

*Primary Examiner*—Brian K. Green
*Assistant Examiner*—James M. Hewitt
*Attorney, Agent, or Firm*—Fay, Sharpe, Fagan, Minnich & McKee LLP

[57] ABSTRACT

A merchandise display assembly includes a support member and a hook projecting from the support member for slideably suspending associated merchandise items. The hook includes a back end which is mounted to the support member and a front end having a retainer construction for preventing merchandise items from sliding off the hook. A resilient one piece label holder is mounted on the hook for providing product information concerning merchandise items suspended on the hook. The holder includes a mounting section by which the holder is mounted on a back end of the hook. The holder also includes an intermediate section extending from the mounting section. The intermediate section includes a plateau and a border region surrounding the plateau. The plateau is located out of a plane of the border region to add stiffness to the intermediate section. A display section, which extends forwardly from the intermediate section, is so positioned and located as to extend in front of a tip of the hook.

22 Claims, 6 Drawing Sheets

LABEL HOLDER

BACKGROUND OF THE INVENTION

This invention relates to label holders and product identification tags for merchandise suspended from a horizontally extending support hook or the like. More particularly, the present invention relates to label holders which are easily attached to and removed from product support hooks without being subject to inadvertent removal.

Label holders or product identification tags are known in the art. They are conventionally formed from a plastic sheet which is die cut into the appropriate shape so as to display product information forwardly of items suspended from a horizontally extending hook. The hook can extend from a pegboard or the like. The holder includes a mounting portion arranged to be temporarily deformed while being attached to and removed from the hook at a location adjacent to the board, an intermediate portion which projects forwardly over the support hook, and the merchandise supported thereon, and a display portion which bends downwardly from the distal end of the intermediate portion in front of the hook so as to display the desired product identification and information data.

Many known label holders are prone to lateral bending or flexing of the holder along its intermediate portion as a result of customers contacting the holder. This results in the display portion of the holder being positioned beside the suspended merchandise and not in front of it. Thus, the label holder is out of view of customers. Such bending or flexing can occur when a merchandise item is being removed from an adjacent hook by a customer who accidentally brushes against the holder. In order to deal with this problem, one known product employs longitudinally extending ribs or longitudinal rows of perforations along the intermediate portion. These are meant to promote transverse flexure of the intermediate portion of the holder into a bowed configuration to reinforce the holder against longitudinal and lateral flexure. Another known product employs side wings which are integral with and extend downwardly from the side edges or margins of the intermediate portion to impart longitudinal stiffness to the intermediate portion. The side wings are folded downwardly from the intermediate portion along longitudinally extending preformed fold lines so that the wings are located substantially perpendicular to the plane of the intermediate portion and are co-extensive in length with the intermediate portion. Other manufacturers simply use thicker sheet material for the intermediate portion in order to provide more stability and resistance to lateral bending.

Still another known product uses scalloping on downwardly turned edges of the intermediate portion to stabilize the intermediate portion. This structure also prevents packages supported on the hook from sliding forward or backward along the hook. Another way of stabilizing the intermediate portion of the label holder on the hook, while at the same time preventing movement of articles on the hook, is by means of a tab which folds downwardly out of the intermediate portion and around the hook via at least one aperture in the tab to accommodate the hook.

It is also known to provide a slot near the distal end of the intermediate portion in order to accommodate a tip of the hook. This design is meant to prevent both a drooping of the intermediate portion and lateral movement of the label holder in relation to the hook.

All of these means for preventing longitudinal flexure of the intermediate portion and a drooping of the distal end of the intermediate portion have drawbacks.

Perforations or creases which promote transverse flexure of this strip into a bowed configuration when the strip is squeezed laterally necessitate a means for perforating or creasing the intermediate portion and an additional means for squeezing the strip laterally to produce the bowed configuration. Employing wings along the sides of the intermediate portion necessitates the use of additional material for the intermediate portion. It also necessitates a means for folding down the wings before use of the label holder so that the wings can perform their stiffening function. The provision of an aperture near the distal end of the intermediate portion to accommodate a tip of the hook does not prevent a lateral motion of the intermediate portion and only prevents further sagging of the intermediate portion.

Further, it is known to provide a hanger guard which has a series of spaced ribs extending along an intermediate portion of the guard at a location rearwardly of a bubble which enshrouds the top and sides of the tip. This guard is a one piece member molded of resiliently flexible plastic. However, such a design would need to be modified to be used as a label holder. In addition, the provision of multiple spaced ribs means that the part requires a complex mold to manufacture.

Accordingly, it has been considered desirable to develop a new and improved label holder which would overcome the foregoing difficulties and others while providing better and more advantageous overall results.

BRIEF SUMMARY OF THE INVENTION

In accordance with the present invention, a label holder is provided.

More particularly in accordance with this aspect of the invention, the label holder comprises a mounting portion by which the holder is mounted on a back end of an associated hook and an elongated portion extending from the mounting portion. The elongated portion includes a centrally positioned plateau which serves as a stiffening element for the elongated portion. Also provided is a display portion connected to the elongated portion with the display portion extending in front of a tip of the associated hook.

In accordance with another aspect of the invention, a merchandise display assembly is provided.

More particularly in accordance with this aspect of the invention, the assembly comprises a support member and a hook projecting from the support member for slidably suspending associated merchandise items. The hook includes a back end which is mounted in the support member and a front end having a retainer member for preventing merchandise items from sliding off the hook. Also provided is a one piece label holder for displaying a label in front of the tip of the hook. The label holder comprises a mounting portion by which the holder is mounted on the back end of the hook and an elongated portion extending forwardly from the mounting portion. The elongated portion includes a centrally positioned stiffening plateau extending over the hook. Also provided is a display portion positioned forwardly of the tip of the hook with the display portion being connected to the elongated portion.

One advantage of the present invention is the provision of a new and improved merchandise display assembly including a label holder.

Another advantage of the present invention is the provision of a resilient one piece label holder which has a display portion positioned forwardly of a tip of a merchandise supporting hook mounted on a support structure.

Still another advantage of the present invention is the provision of a label holder made from a sheet of conventional thermoplastic material via vacuum forming.

Yet another advantage of the present invention is the provision of a label holder which installs quickly without the need to remove either the packaged product from the hook or the hook from the pegboard or other support member to which the hook is secured.

Still yet another advantage of the present invention is the provision of a one piece label holder having a mounting section, an elongated intermediate section, including a stiffening member, and a display portion. The stiffening member is a rectangular plateau—having a pair of end walls and a pair of side walls—formed in the intermediate section.

A further advantage of the present invention is the provision of a label holder which can hold a UPC (Uniform Price Code) label at the front end of a hook, either via adhesive or via a pocket formed in the label holder.

A still further advantage of the present invention is the provision of a label holder which includes a plurality of mounting constructions so as to accommodate mounting of the label holder on a variety of types of hooks such as two pronged hooks mounted in a pegboard, over the top hooks, corrugated or wire grid hooks, butterfly hooks and hooks which are accommodated in slots cut in cardboard.

Still other benefits and advantages of the present invention will become apparent to those of average skill in the art upon a reading and understanding of the following detailed specification.

BRIEF DESCRIPTION OF THE DRAWINGS

The invention may take physical form in certain parts and arrangements of parts preferred embodiments of which will be described in detail in this specification and illustrated in the accompanying drawings which form a part hereof and wherein.

DETAILED DESCRIPTION OF THE PREFERRED EMBODIMENTS

Figure 4:
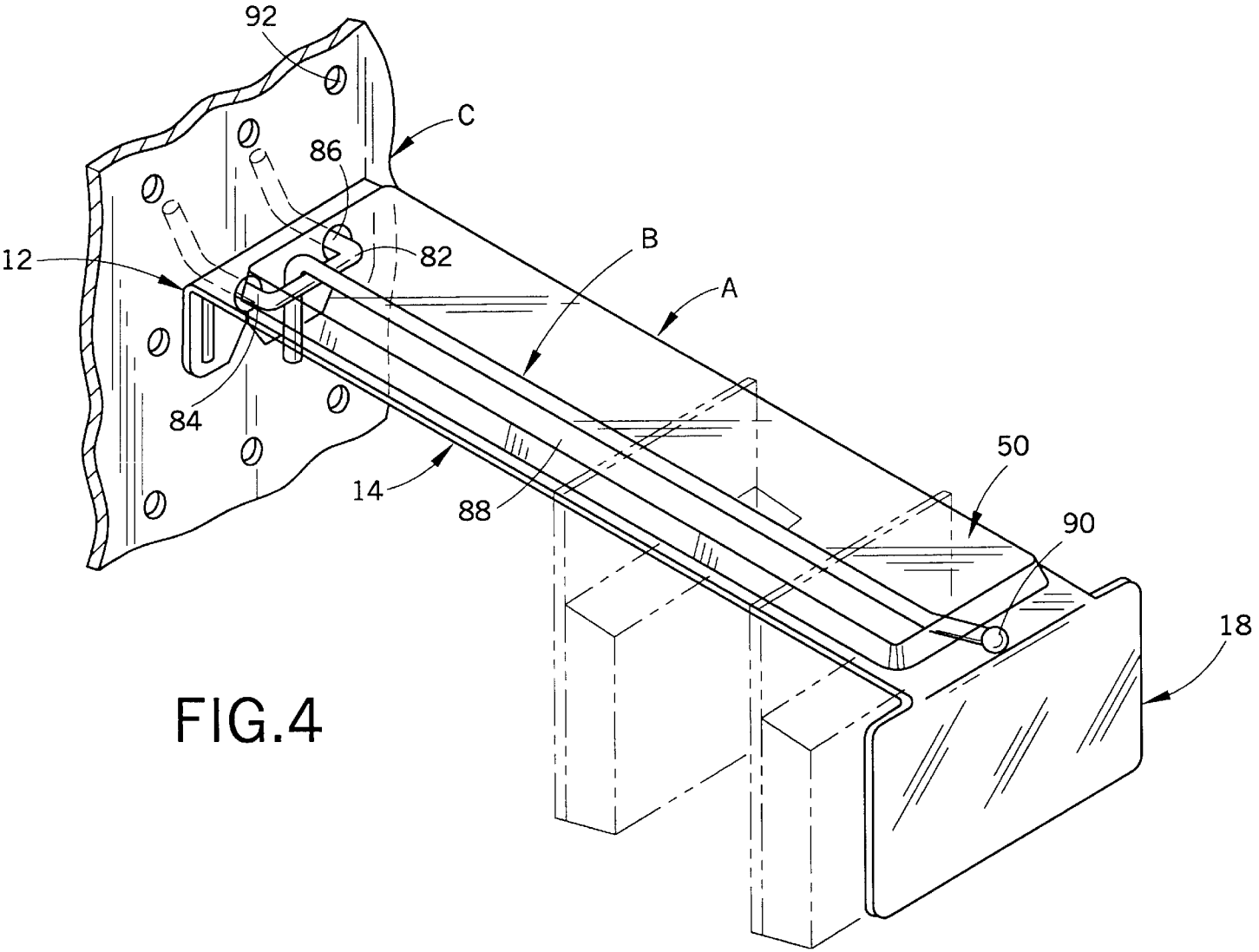
FIG. 4 is a perspective view of the label holder of FIG. 1 as it is mounted on a hook fastened on a pegboard.

Referring now to the drawings wherein the showings are for purposes of illustrating several preferred embodiments of the invention only and not for purposes of limiting same, FIG. 4 shows a merchandise display assembly including a label holder A mounted above a hook B wherein the hook is secured to a pegboard C. While a particular type of hook B is illustrated in FIG. 4 and this hook is shown as being secured to a known type of pegboard C, it should be appreciated by those of average skill in the art that there are many varieties of known hooks other than the hook B and there are also many varieties of support structures other than the pegboard C to which such conventional merchandising support hooks can be secured.

Figure 1:
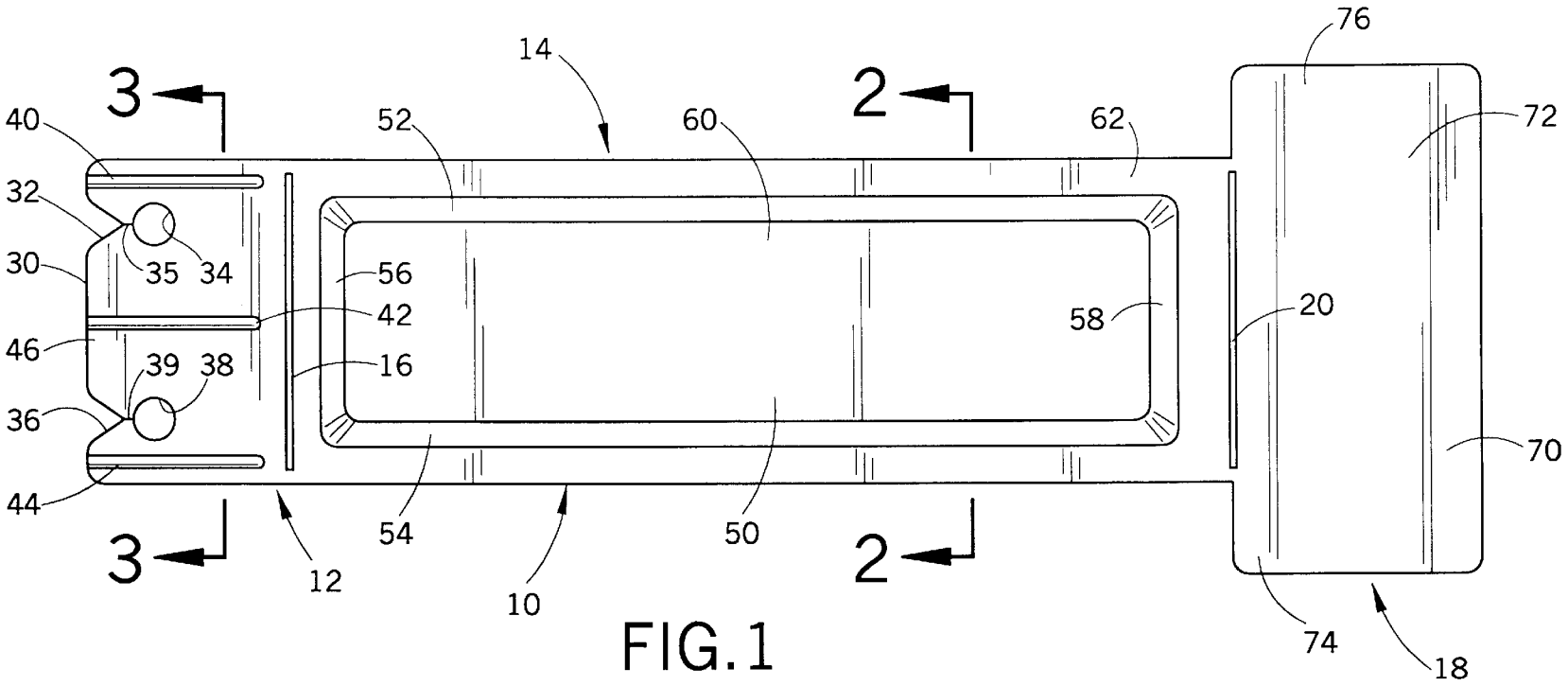
FIG. 1 is a top plan view of a label holder blank from which a label holder according to a first preferred embodiment of the present invention is formed by appropriate folding.
Figure 3:
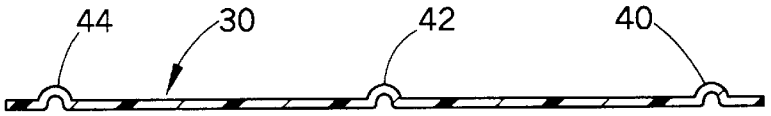
FIG. 3 is an enlarged cross-sectional view of the label holder of FIG. 1 along line 3—3.

With reference now to FIG. 1, the label holder A includes a body 10 having a mounting section 12, an intermediate section 14 separated from the mounting section by a first crease line 16 and a display section 18 separated from the intermediate section by a second crease line 20. The mounting section includes a rear edge 30 on which is provided a first indented portion 32 leading to a first aperture 34 via a first cut line 35 and a second indented portion 36 leading to a second aperture 38 via a second cut line 39. Also provided on the mounting section 12 are first, second and third spaced reinforcing ribs 40, 42 and 44. The ribs are preferably oriented perpendicular to the rear edge 30 and are so spaced that the first and third ribs 40, 44 are located outboard of the first and second apertures 34 and 38 whereas the second rib 42 is located on a tongue 46 defined between the two apertures.

Figure 2:
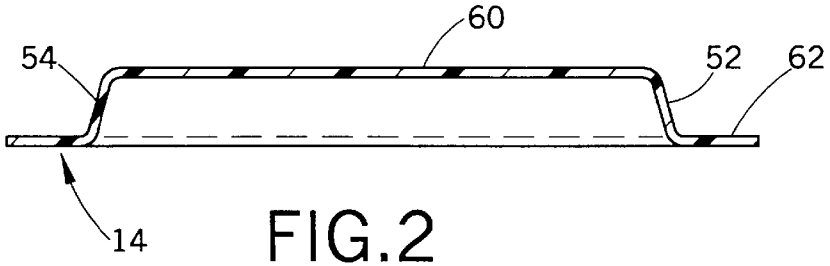
FIG. 2 is an enlarged cross-sectional view of the label holder of FIG. 1 along line 2—2.

The intermediate section 14 comprises a plateau 50 which is positioned out of the plane of the remainder of the intermediate section. The plateau comprises first and second side walls 52 and 54 and first and second end walls 56 and 58, as well as a top wall 60. Defined around the plateau and forming the remainder of the intermediate section is a racetrack shaped border 62. As shown in FIG. 2, the plane of the top wall 60 is located above the plane of the border 62. It is apparent from FIG. 1 that the surface area of the plateau 50 is greater than is the surface area of the border 62. It should be noted from FIG. 2 that the walls 52–58 of the plateau are angled outwardly somewhat from the top wall 60, toward border 62.

The display section 18 of the body 10 includes a planar panel 70 having a front surface 72 which is particularly adapted for mounting adhesive labels therein. It is apparent from FIG. 1 that the panel 70 is wider than is the intermediate section 14 such that a pair of side portions 74 and 76 of the panel 70 extend past the sides of the intermediate section 14. This feature enables the label holder to accept wider labels.

With reference now again to FIG. 4, the hook B includes a mounting portion 82 having a first arm 84 and a second arm 86 which are spaced from each other, a central portion 88 and a tip 90. The pegboard C includes a series of apertures 92 which are so sized and spaced as to accommodate the two arms 84 and 86 of the hook B. The label holder is mounted on the hook B such taht the mounting section 12 is located between the hook's mounting portion 82 and the pegboard; the intermediate section 14 overlies the hook central portion 88 and the display section 18 is located in front of the hook tip 90.

The plateau 50 adds stiffness to the intermediate section 14 of the label holder and prevents a sagging of the intermediate section down onto the hook B. Moreover, the plateau enhances the lateral stability of the intermediate section retarding any sideways movement of the intermediate section. The relative size of the plateau 50 in relation to the border 62 increases the resistance of the intermediate section to sagging and to sideways movement. The border region 62 preferably substantially surrounds at least three sides of the plateau. In the embodiment of FIG. 2, the border region 62 completely surrounds all four sides of the plateau 50.

Preferably, the label holder A is made from a suitable conventional thermoplastic material, such as a clear or transparent PETG. It can have a thickness of 0.015 inches if desired. The plateau is formed in the intermediate section by the known process of vacuum forming. The shape of the plateau is advantageous from the standpoint of ease of vacuum forming. The holder is then die cut out of a sheet of the thermoplastic material and folded into the appropriate shape via crease lines 16 and 20.

The label holder of the present invention can have a variety of mounting sections and display sections, as will be discussed hereafter.

Figure 5:
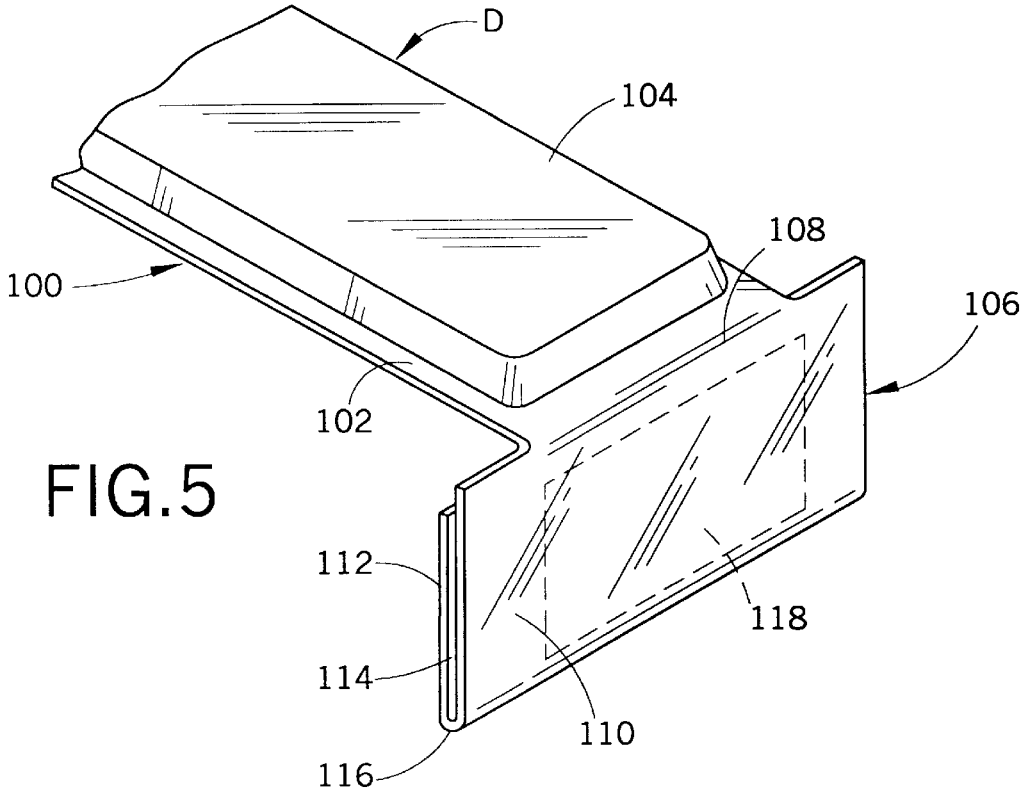
FIG. 5 is a perspective view of a front portion of a label holder according to a second preferred embodiment of the present invention.

With reference now to FIG. 5, a label holder D according to a second preferred embodiment of the invention is there illustrated. In this embodiment, the label holder comprises a body 100 having an intermediate portion 102 with a plateau 104. A display section 106 is spaced from the intermediate portion 102 by a crease line 108. The display section comprises a front panel 110 and a rear panel 112 which define between them a slot 114. The two panels are connected at a connecting wall 116. At least the front panel 110 is made from a clear material. A label 118 can be accommodated between the front and rear panels 110 and 112. Since the rear panel 112 is shorter than is the front panel, access can be had to the slot 114 by simply bending the rear panel backwards. Due to the resilience of the thermoplastic material from which the label holder is made, the rear panel will return to its normal position when no longer bent.

The embodiment of FIG. 5 is useful in a situation where the label is a non-adhesive label and could not be accommodated by the label holder illustrated in FIGS. 1–4. Once a label 118 is held in the slot, the label is prevented from falling out of the slot, due to gravity by the provision of the connecting wall 116.

Figure 6:
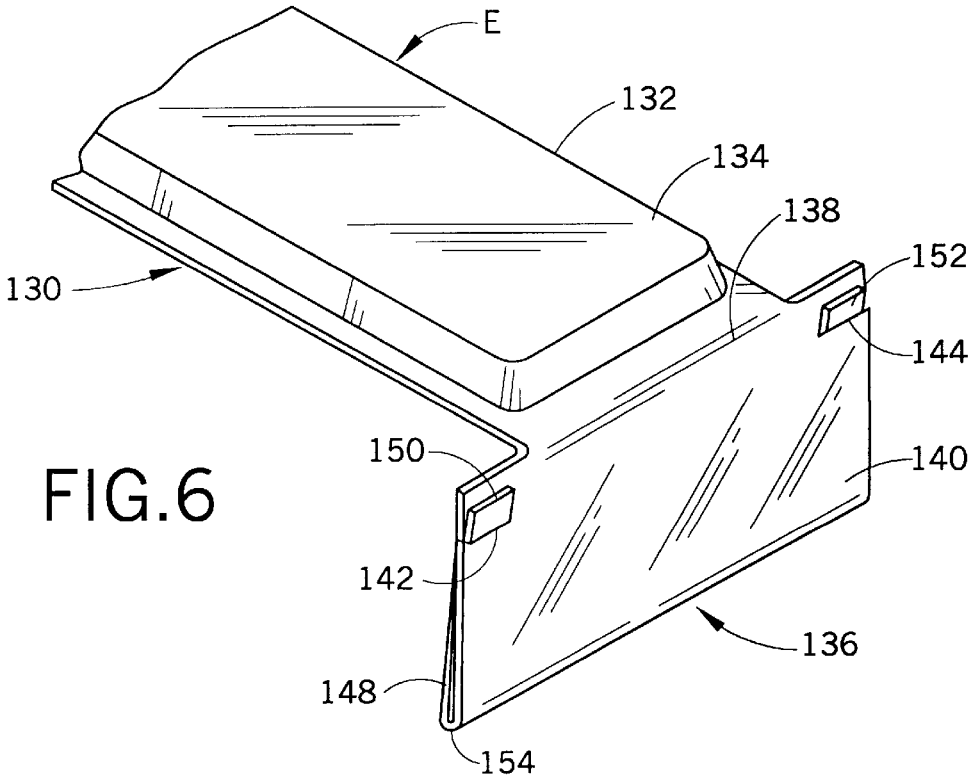
FIG. 6 is a perspective view of a front portion of a label holder according to a third preferred embodiment of the present invention.

With reference now to FIG. 6, a label holder E according to a third preferred embodiment of the invention is there illustrated. This label holder includes a body 130 having an intermediate portion 132 with a plateau 134. A display section 136 is separated from the intermediate portion via a crease line 138. The display section includes a front wall panel 140. Defined in the front wall panel are first and second cut lines 142 and 144 disposed along opposing side edges of the front panel. The display section also includes a rear panel 148 which is provided with spaced first and second tabs 150 and 152 that are so sized and located as to engage in the respective cuts 142 and 144. The front and rear panels are joined along a bottom connecting wall 154. This label holder can accommodate a non-adhesive label in such a way to lock the label in place between the front and rear panels when the tabs 150 and 152 are inserted in the cuts 142 and 144.

Figure 7:
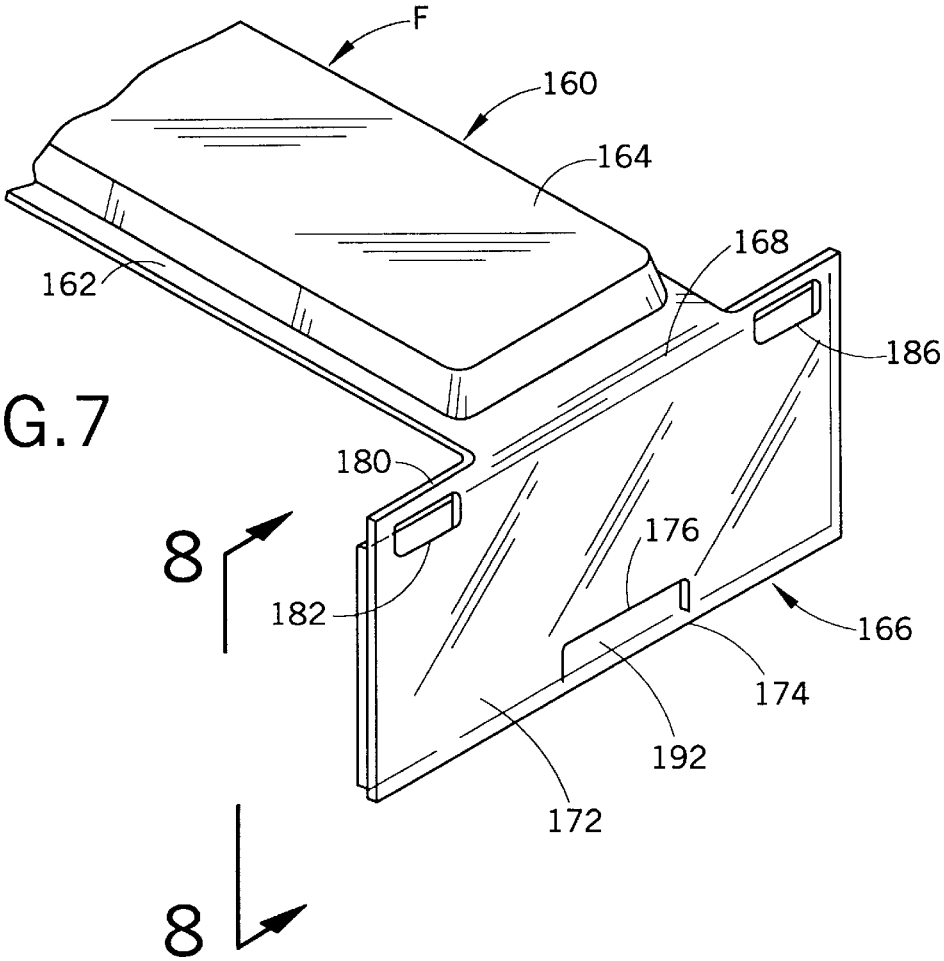
FIG. 7 is a perspective view of a front portion of a label holder according to a fourth preferred embodiment of the present invention.
Figure 8:
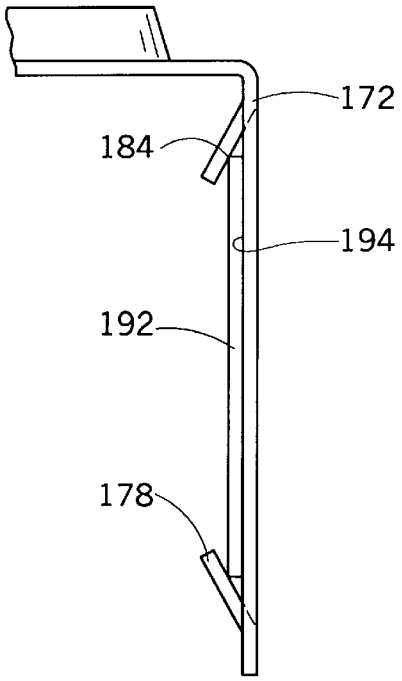
FIG. 8 is an enlarged side elevational view of a front end of the label holder of FIG. 7.

With reference now to FIG. 7, a fourth preferred embodiment of the present invention includes a label holder F having a body 160 with an intermediate section 162 on which is located a plateau 164. Also provided is a display section 166 which is separated from the intermediate section by a crease line 168. The display section comprises a wall panel 172 having a bottom edge 174. Spaced from the bottom edge is a U-shaped cut 176 forming a central tab 178 (FIG. 8). Spaced from a top edge 180 of the panel 172 are a second U-shaped cut 182 forming a first side tab 184 (FIG. 8) and a third Ushaped cut 186 forming a second side tab (not visible in FIG. 7 or FIG. 8). As illustrated in FIG. 8, this embodiment of the invention allows a label 192 to be held against a rear surface 194 of the panel 172 by the three tabs which have been bent out of the plane of the wall panel 172.

Figure 9:
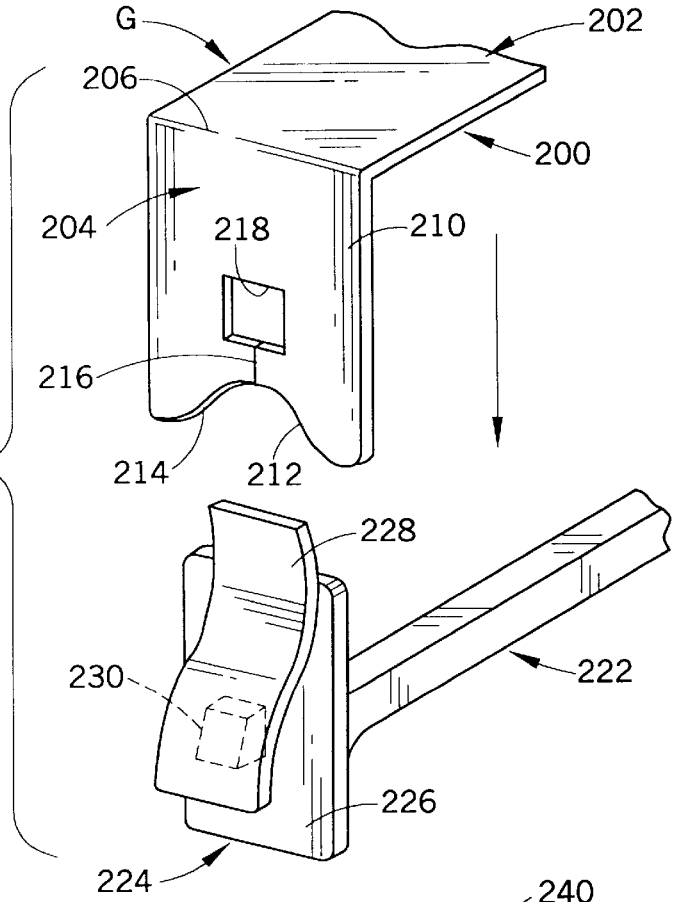
FIG. 9 is an exploded perspective view of a rear end of a label holder adapted for use with a display hook.

With reference now to FIG. 9, a label holder G according to another preferred embodiment of the present invention includes a body 200 with an intermediate section 202 and a mounting section 204 separated therefrom by a crease line 206. The mounting section 204 comprises a panel 210 having a distal edge 212 in which there is provided an indented portion 214 communicating with a cut 216 which leads to an opening 218.

The label holder is meant for use with a display hook 222 having a mounting section 224 comprising a first wall member 226 and, spaced therefrom and approximately parallel thereto, a second wall member 228. These are joined by a connecting wall 230. The connecting wall is somewhat rectangular in shape. The label holder can be mounted on the display hook 222. The opening 218 of the mounting section 204 is also somewhat rectangular in shape in order to accommodate the connecting wall 230. The mounting section can be slid onto the connecting wall via the cut 216 as the label holder is made from a suitable resilient material such as a thermoplastic.

Figure 10:
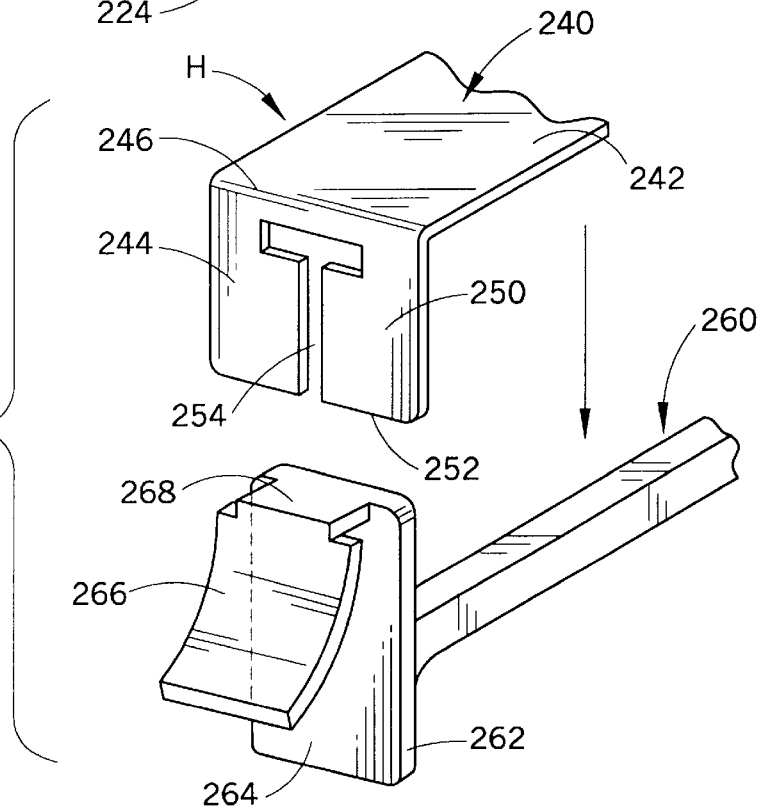
FIG. 10 is an exploded perspective view of a rear end of a label holder adapted for use with an over-the-top hook.

With reference now to FIG. 10, a label holder H according to another preferred embodiment of the present invention comprises a body 240 with an intermediate section 242 separated from a mounting section 244 by a crease line 246. The mounting section comprises a panel 250 having a distal edge 252 in which there is provided a T-shaped slot 254. This label holder is meant to be employed with an over-the-top hook 260 having a mounting section 262 comprising a first wall 264 separated from a second, smaller, wall 266 by a connecting wall 268. It is apparent that the connecting wall is narrower in width than are the first and second walls. The T-shaped slot 254 of the label holder H accommodates the connecting wall 268. To this end, the label holder H is made from a suitable known thermoplastic material which can flex to allow the connecting wall 268 to pass through the narrow section of the T-shaped slot 254 and be held in the wide section thereof. In this fashion, the label holder can be held on the hook 260.

Figure 11:
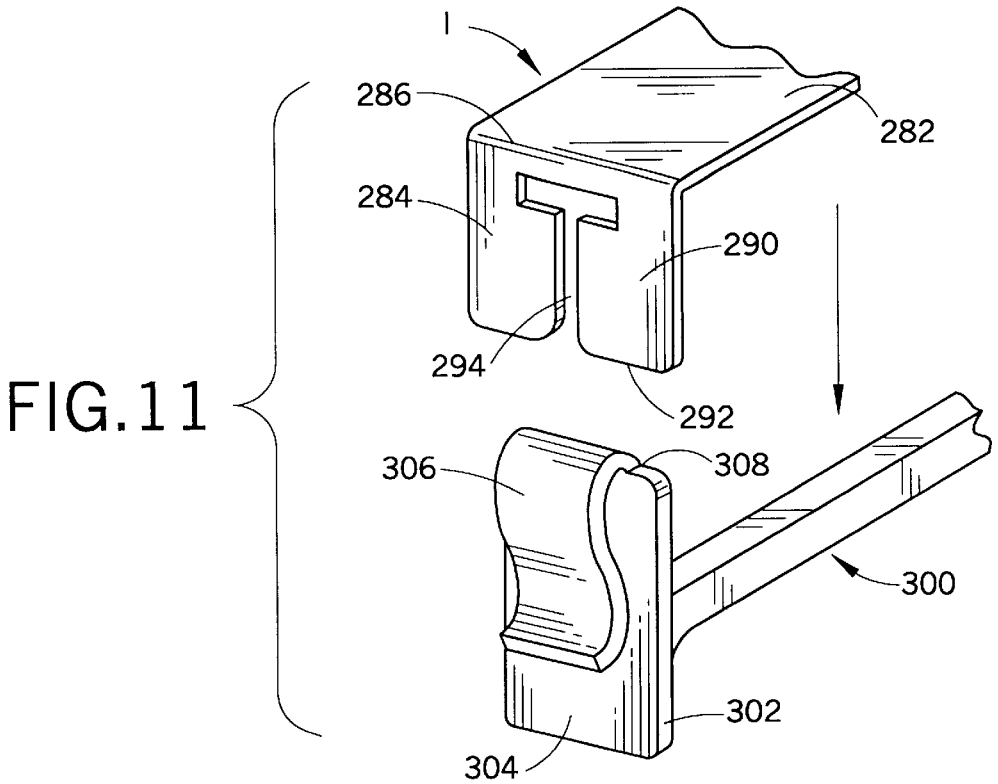
FIG. 11 is an exploded perspective view of a rear end of a label holder adapted for use with a corrugated/wire grid hook.

With reference now to FIG. 11, a label holder I according to another preferred embodiment of the present invention includes a body having an intermediate section 282 and a mounting section 284 which are connected along a crease line 286. The mounting section includes a panel 290 having a distal edge 292 which communicates with a T-shaped slot 294 formed in the panel.

The label holder 280 is meant to be accommodated on a corrugated wire or grid hook 300 having a mounting section 302 including a wall panel 304 and a curved finger 306 extending rearwardly from a top edge 308 of the wall panel. The T-shaped slot 294 in the mounting section 284 accommodates the curved finger 306.

Figure 12:
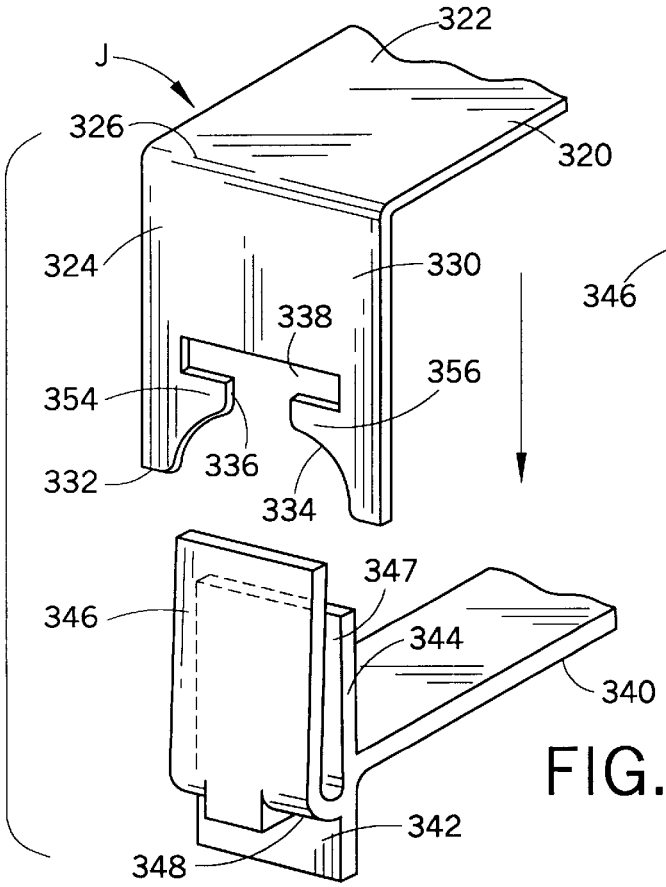
FIG. 12 is an exploded perspective view of a rear end of a label holder adapted for use with a butterfly hook; and, FIG. 13 is a side elevational view of the label holder and hook of FIG. 12 in an assembled condition.

With reference now to FIG. 12, another form of a label holder J according to still a further preferred embodiment of the present invention comprises a body 320 with an intermediate portion 322 and a mounting portion 324. A crease line 326 separates the two. The mounting portion comprises a panel 330 having a distal edge 332 in which is located an indented section 334 leading to a narrowed channel 336. The channel communicates with a widened slot 338 defined in the panel 330. This label holder is meant to be accommodated on a butterfly hook 340 having a mounting section 342 which comprises a first wall 344 and a second wall 346 spaced therefrom. The two walls are substantially parallel to each other and defined between them is a slot 347. A bridge or a connecting wall 348 secures the two walls 344 and 346 to each other.

Figure 13:
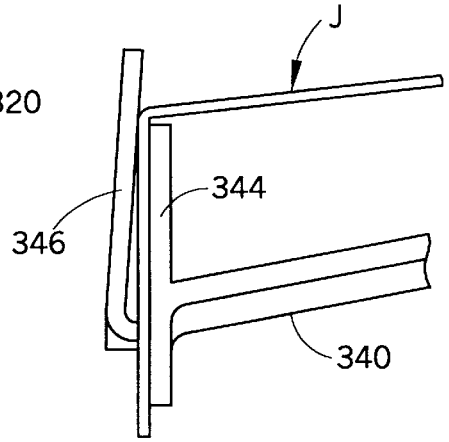

With reference now to FIG. 13, the butterfly hook 340 is meant to be accommodated in a slot in a cardboard panel. The label holder, in turn, is held on the butterfly hook mounting section 342 by cooperation of first and second locking tabs 354 and 356 defined on the panel 330 with the bridge 348 of the butterfly hook 340.

The invention has been described with reference to several preferred embodiments. Obviously, modifications and alterations will occur to others upon a reading and understanding of this specification. It is intended to include all such modifications and alterations insofar as they come within the scope of the appended claims and the equivalents thereof.

What is claimed:

1. A merchandise display assembly comprising:

a support member;

a hook projecting from the support member for slidably suspending associated merchandise items, said hook including a back end which is mounted to said support member and a front end having a retainer construction for preventing the merchandise items from sliding off said hook; and, a resilient one piece label holder for providing product information concerning merchandise items suspended on said hook, said holder comprising:

a mounting section by which said holder is mounted on said back end of said hook, an intermediate section extending from said mounting section, said intermediate section including a plateau and a border region surrounding said plateau, said plateau being located out of a plane of said border region to add stiffness to said intermediate section, said plateau comprising first and second end walls wherein said border region extends past said plateau first and second end walls, and a display section extending forwardly from said intermediate section and in front of said hook front end.

2. The display assembly of claim 1 wherein a surface area of said plateau is greater than a surface area of said border region.

3. The display assembly of claim 2 wherein said plateau further comprises a first side wall, a second side wall and a top wall.

4. The display assembly of claim 3 wherein said side walls and said end walls of said plateau are disposed at an acute angle in relation to said plane of said border region.

5. The display assembly of claim 1 wherein said display section comprises a first panel and a second panel which are substantially parallel to each other and form a slot between them for accommodating an associated label.

6. The display assembly of claim 5 wherein said first panel comprises a pair of spaced slits and said second panel comprises a pair of spaced tabs which are so sized and shaped as to be held in said pair of spaced slits.

7. The display assembly of claim 1 wherein said mounting section comprises a reinforcing rib extending longitudinally along said mounting section.

8. The display assembly of claim 1 wherein said display section comprises a panel including at least a pair of tabs which can be folded out of a plane of said panel.

9. The display assembly of claim 1 wherein said mounting section comprises:

an indented portion;

a slit communicating on a first end with said indented portion; and, an opening with which a second end of said slit communicates.

10. The display assembly of claim 1 wherein said mounting section comprises:

an indented portion;

a slot communicating with said indented portion;

a first locking tab located on a first side of said slot; and, a second locking tab located on a second side of said slot.

11. The display assembly of claim 1 wherein said mounting section comprises:

a first edge; and, a slot extending away from said first edge, said slot comprising a first portion which is approximately perpendicular to said first edge and a second portion which is approximately parallel to said first edge.

12. A one piece label holder which extends before a tip of an associated merchandise display hook for providing product information concerning merchandise items suspended on the hook, said holder comprising:

a mounting section by which said holder is mounted to the associated hook;

an intermediate section extending from said mounting portion, said intermediate section including a plateau and a border region surrounding said plateau, said plateau being located in a plane different from a plane of said border region to add stiffness to said intermediate section, wherein said plateau has a plurality of sides and wherein said border region extends around each side of said plateau; and, a display section extending forwardly of said intermediate section and in front of the tip of the associated hook.

13. The label holder of claim 12 wherein said plateau comprises a first end wall, a second end wall, a first side wall, a second side wall and a top wall.

14. The label holder of claim 13 wherein said walls of said plateau are disposed at an acute angle in relation to said plane of said border region.

15. The display assembly of claim 12 wherein said display section comprises a first panel and a second panel, wherein said first and second panels are oriented substantially parallel to each other and form a slot between them for accommodating an associated label.

16. The label holder of claim 12 wherein said mounting section comprises:

a first edge; and, a slot extending away from said first edge, said slot comprising a first portion which is approximately perpendicular to said first edge and a second portion which is approximately parallel to said first edge.

17. An elongated one piece label holder made from a resilient material for providing product information concerning merchandise items suspended from an associated hook wherein said label holder extends over the associated hook, said label holder comprising:

a mounting section by which said holder is mounted to the associated hook;

an intermediate section extending forwardly from said mounting section, said intermediate section including a plateau and a border region, said plateau being located out of a plane of said border region to add stiffness to said intermediate section, wherein said plateau comprises a first end wall, a second end wall, a first side wall, a second side wall and a top wall and wherein said border region substantially surrounds at least three sides of said plateau and includes a first portion located adjacent said plateau first end wall; and, a display section extending forwardly from said intermediate section and in front of a tip of the associated hook wherein said border region first portion is located between said plateau first end wall and said display section.

18. The label holder of claim 17 wherein said walls of said plateau are oriented at an acute angle in relation to said plane of said border region.

19. The label holder of claim 17 wherein said display section comprises a first panel and, spaced therefrom, a second panel which extends substantially parallel to said first panel, wherein said first and second panels form a slot between them for accommodating an associated label.

20. The label holder of claim 17 wherein said mounting section comprises:

a first edge;

a slot extending away from said first edge, said slot comprising a first portion which is approximately perpendicular to said first edge and a second portion which is approximately parallel to said first edge.

21. The label holder of claim 17 wherein said mounting section comprises:

a first indented portion;

a second indented portion spaced from said first indented portion;

a first slit communicating on a first end with said first indented portion;

a second slit communicating on a first end with said second indented portion;

a first opening with which a second end of said first slit communicates; and, a second opening with which a second end of second slit communicates.

22. The display assembly of claim 21 wherein said mounting section further comprises at least one stiffening rib which extends approximately parallel to said first and second slits.

* * * * *